US006833816B2

(12) United States Patent
Hilgers

(10) Patent No.: US 6,833,816 B2
(45) Date of Patent: Dec. 21, 2004

(54) ANTENNA WITH SUBSTRATE AND CONDUCTOR TRACK STRUCTURE

(75) Inventor: Achim Hilgers, Alsdorf (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/258,045

(22) PCT Filed: Mar. 19, 2002

(86) PCT No.: PCT/IB02/00904

§ 371 (c)(1),
(2), (4) Date: Oct. 18, 2002

(87) PCT Pub. No.: WO02/075851

PCT Pub. Date: Sep. 26, 2002

(65) Prior Publication Data

US 2003/0142019 A1 Jul. 31, 2003

(30) Foreign Application Priority Data

Mar. 20, 2001 (DE) ..... 101 13 349

(51) Int. Cl.[7] ..... H01Q 1/38
(52) U.S. Cl. ..... 343/700 MS; 343/702
(58) Field of Search ..... 343/700 MS, 702, 343/846, 848

(56) References Cited

U.S. PATENT DOCUMENTS 5,588,198 A 12/1996 Kawahata et al. ..... 29/600
5,952,972 A 9/1999 Ittipiboon et al. ... 343/700 MS
6,501,425 B1 * 12/2002 Nagumo et al. ..... 343/700 MS
6,559,802 B2 * 5/2003 Goto et al. ..... 343/702
6,639,556 B2 * 10/2003 Baba ..... 343/700 MS
6,646,609 B2 * 11/2003 Yuasa et al. ..... 343/700 MS
2002/0075186 A1 * 6/2002 Hamada et al. ..... 343/700 MS
2002/0154062 A1 * 10/2002 Abe et al. ..... 343/700 MS
2003/0063030 A1 * 4/2003 Stoiljkovic et al. .. 343/700 MS

FOREIGN PATENT DOCUMENTS

EP 0766340 A2 4/1997 ..... H01Q/9/04
EP 0923153 A1 6/1999 ..... H01Q/1/36
WO 021946464 3/2002 ..... H01Q/1/00

* cited by examiner

*Primary Examiner*—Tan Ho

(57) ABSTRACT

An antenna (1) is described with a dielectric or permeable substrate (10) and at least one resonant conductor track structure (20) which is provided in particular for use in the high-frequency and microwave ranges and which is characterized in that the substrate (10) comprises at least one cavity (30). The cavity is preferably provided in a main surface of the substrate such that the latter has substantially the shape of a U-profile. This cavity not only enhances the radiation efficiency, but it also considerably reduces the total weight of the antenna. Further advantages of the antenna are that it offers a high degree of miniaturization as well as the possibility of surface mounting (SMD) on, for example, a printed circuit board (PCB).

15 Claims, 2 Drawing Sheets

ANTENNA WITH SUBSTRATE AND CONDUCTOR TRACK STRUCTURE

The invention relates to an antenna with a dielectric (or permeable) substrate and at least one resonant conductor track structure, designed in particular for use in the high-frequency and microwave range, for example for mobile dual-band or multiband telecommunication devices (cellular and cordless telephones), as well as for devices which communicate in accordance with the Bluetooth standard. The invention further relates to a circuit board and to a telecommunication device having such an antenna.

To follow the trend towards ever smaller electronic components, in particular in the field of telecommunication technology, all manufacturers of passive and/or active electronic components enhance their activity in this field. Particular problems then arise in the use of electronic components in the field of high-frequency and microwave technology, because numerous properties of the components are dependent on their physical dimensions, and because the wavelength of the signal becomes smaller as the frequency rises, which in its turn leads to an interference with the supplying signal source in particular owing to reflections.

This relates to a particularly high degree to the structure of the antenna of such an electronic device, for example of a mobile telephone, which is more strongly dependent on the desired frequency range of the application than are all other HF components. This is because the antenna is a resonant component which is to be adapted to the respective application, i.e. the operating frequency range. In general, wire antennas are used for transmitting the desired information. Certain physical lengths are absolutely necessary in order to achieve good radiation and reception characteristics with these antennas.

Optimum radiation characteristics are found in so-called $\lambda/2$ dipole antennas whose length corresponds to half the wavelength ($\lambda$) of the signal in free space. These antennas are each formed from two wires of $\lambda/4$ length which are rotated through 180° with respect to one another. These dipole antennas, however, are too large for many applications, in particular for mobile telecommunication (the wavelength is approximately 32 cm in the GSM900 band), which is why alternative antenna structures are used. A widely used antenna in particular for the field of mobile telecommunication is the so-called $\lambda/4$ monopole. This consists of a wire having a length of one fourth the wavelength. The radiation characteristic of this antenna is acceptable while at the same time its physical length (approximately 8 cm for the GSM band) can be accommodated. Furthermore, antennas of this kind distinguish themselves by a high impedance and radiation bandwidth, so that they can also be used in systems which require a comparatively large bandwidth. To achieve an optimum power adaptation to 50 ohms, a passive electrical adaptation is chosen for this kind of antennas, as indeed for most $\lambda/2$ dipoles. This adaptation usually consists of a combination of at least one coil and one capacitance, which adapts the input impedance of the $\lambda/4$ monopole different from 50 Ω to the connected 50 Ω component, given a suitable dimensioning.

Even though antennas of this kind are widely used, they still have considerable disadvantages. The latter are found on the one hand in the passive adaptation circuit mentioned above.

On the other hand, for example, mobile telephones are usually fitted with a pull-out wire antenna. Such $\lambda/4$ monopoles cannot be soldered directly to a circuit board. The result of this is that expensive contacts are necessary for the signal transmission between the circuit board and the antenna.

A further disadvantage of this kind of antennas is the mechanical instability of the antenna itself as well as the adaptation of the housing to the antenna made necessary by this instability. If, for example, a mobile telephone is dropped on the floor, the antenna will usually break off, or the housing is damaged in the location where the antenna can be pulled out.

To avoid these disadvantages, antennas were developed in which one or several resonant metal structures are provided on a dielectric substrate having a dielectric constant $\epsilon_r>1$. Since the wavelength in the dielectric is smaller than that in vacuum by a factor $1/\sqrt{\epsilon_r}$, antennas reduced in size by that same value can be manufactured.

A further advantage of these antennas is that they can be directly provided on a printed circuit board (PCB) by means of surface mounting (SMD technology), i.e. through planar soldering and contacting on the conductor tracks—possibly together with other components—, without additional retention means (pins) for the supply of the electromagnetic power being necessary.

It is an object of the invention to provide an antenna with a dielectric (or permeable) substrate and at least one resonant conductor track structure which is further improved as regards its radiation properties.

In addition, such an antenna is to be provided which has as small a weight as possible and which can be provided on a printed circuit board in particular through surface mounting (SMD technology), i.e. through planar soldering and contacting on the conductor tracks—possibly together with other components—, without additional retention means (pins) for supplying the electromagnetic power being necessary.

These antennas should in particular be configured such that they are suitable for use in the high-frequency and microwave ranges, that they have a bandwidth which is as large as possible and/or tunable, and that they are capable of miniaturization to a high degree and mechanically particularly stable.

This object is achieved according to claim 1 by means of an antenna formed by a dielectric (or permeable) substrate and at least one resonant conductor track structure, which is characterized in that the substrate comprises at least one cavity.

It was surprisingly found that the radiation efficiency, and accordingly the radiation properties of the antenna are or can be considerably increased and improved by means of such a cavity. Depending on the shape, size, and number of the cavities, said efficiency may be increased by approximately 15% or more. A particular advantage of this solution is that the weight of the antenna becomes substantially lower at the same time.

This solution is particularly advantageous for miniaturized microwave antennas for single-band applications (for example the GSM900 band) as described in DE 100 49 844.2, as well as for dual- and triple-band antennas for the frequency ranges of the GSM900 and the DCS 1800 standards, and also for Bluetooth systems, as disclosed in DE 100 49 845.0. The contents of these publications should accordingly be deemed included in the present disclosure by reference.

It should be noted here that antennas with U-shaped dielectric substrates are known from EP 0 923 153 and U.S. Pat. No. 5,952,972. This, however, relates to substrates which are shaped for the purpose of increasing the impedance bandwidth without measures being taken for increasing the efficiency of the radiated electromagnetic waves. Moreover, said two publications relate to antennas with shell electrodes, U.S. Pat. No. 5,952,972 exclusively describing dielectric resonator antennas (DRA). In these antennas, the operating modes are determined by the bulk resonance, whereas in the antennas according to the invention (PWA—printed wire antennas) without mass electrodes the operating modes are defined by the resonances of the conductor track structure on the substrate. The operating principles are accordingly fundamentally different from one another.

The dependent claims relate to advantageous further embodiments of the invention.

The embodiment of claim 2 relates in particular to substrates made of foam-type materials into which it is not absolutely necessary to provide separate cavities.

In contrast thereto, the embodiments of claims 3 to 5 are to be used first and foremost where solid substrates are provided into which the cavities are introduced in the form of corresponding depressions.

The claims 6 and 7 relate to antennas which can be used in particular for the high-frequency and microwave ranges, the embodiment of claim 6 having a particularly great impedance and radiation bandwidth, and the embodiment of claim 7 being tunable.

Further particulars, features, and advantages of the invention will become apparent from the ensuing description of preferred embodiments which is given with reference to the drawing, in which:

FIG. 1 diagrammatically shows an antenna according to the invention;

The antennas described fundamentally belong to the type of so-called "Printed Wire Antennas" (PWAs), in which a resonant conductor track structure is provided on a substrate. In principle, therefore, these antennas are wire antennas which have no metal surface on the rear side of the substrate acting as a reference potential, in contrast to microstrip antennas.

The embodiments described below each comprise a substrate formed by a substantially cuboid block whose height D is smaller than its length A or width C by a factor of 2 to 10. On the basis thereof, the lower and upper surfaces of the substrate 10 as shown in the Figures will be denoted the lower (first) and upper (second) main surface 11, 12, respectively, in the ensuing description, and the surfaces perpendicular thereto will be denoted the first to fourth side faces 13 to 16.

Alternatively, it is also possible to choose geometric shapes other than a cuboid shape for the substrate such as, for example, a cylindrical shape on which a corresponding resonant conductor track structure is provided, for example following a spiraling path.

The substrates may be manufactured by embedding a ceramic powder in a polymer matrix and have a dielectric constant of $\epsilon_r>1$ and/or a relative permeability of $\mu_r>1$.

Figure 1:
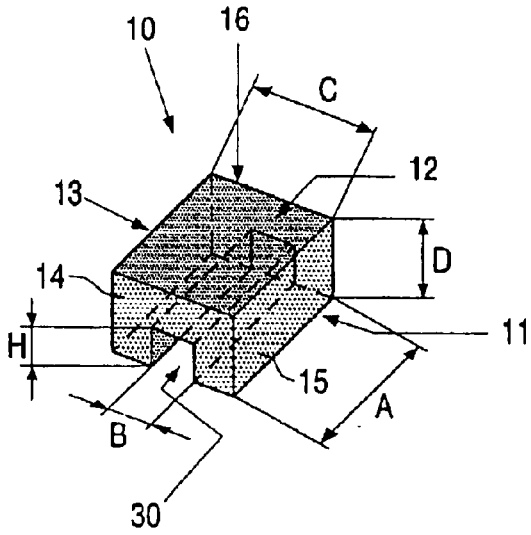
Figure 2:
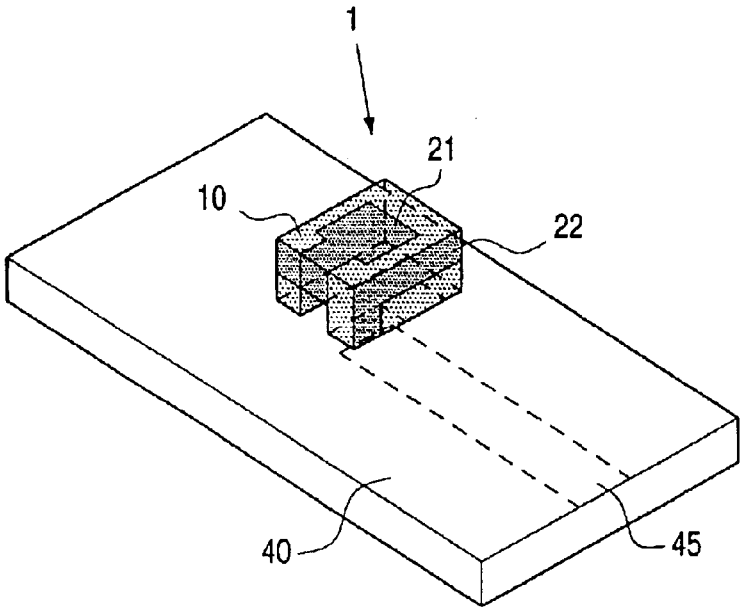
FIG. 2 shows a printed circuit board with such an antenna.

In particular, the antenna 1 of FIGS. 1 and 2 comprises a cuboid dielectric substrate 10 on whose surface a resonant conductor track structure is present.

The conductor track structure is formed by one or several metallizations provided on the substrate 10, as described in the two cited documents DE 100 49 844.2 and DE 100 49 845.0 included herein by reference. These metallizations may be present both on the upper main surface 12 and on one or several of the side faces 13 to 16.

The conductor track structure has an effective length l of $\lambda/2\sqrt{\epsilon_r}$, where $\lambda$ is the wavelength of the signal in free space. The conductor track structure is dimensioned such that its length corresponds to approximately half the wavelength at which the antenna is to radiate electromagnetic power. For example, if the antenna is to be used in the Bluetooth standard operating in a frequency range of between 2400 and 2483.5 MHz, a wavelength of approximately 12.1 cm results in free space. Given a dielectric constant $\epsilon_r$ of the substrate equal to 20, the half wavelength will be shortened, and the required geometric length of the conductor track structure will be reduced to approximately 13.5 mm.

A cavity in the form of a depression is present in the lower main surface 11 of the substrate 10, running as a channel 30 of substantially rectangular cross-section over the entire length of the substrate. The width B of the channel extends over the lower main surface 11, while its height H is at the same time the depth over which the channel 30 is introduced into the substrate 10. This makes the substrate substantially U-shaped.

FIG. 2 shows a printed circuit board (PCB) 40 on which an antenna 1 according to the invention is mounted. For this purpose, solder spots ("footprints") are present on the lower main surface 11 of the substrate, by means of which footprints the substrate 10 is soldered to the printed circuit board 40 in surface mounting (SMD) technology. The conductor track structure is a surface metallization which is formed by a first planar metallization structure 21 on the second main surface 12 and by a conductor track 22 extending along the side faces 13 to 16 of the substrate 10. The conductor track 22 starts at a supply terminal 45 and ends at the second side face 13, where it is connected to the first metallization structure 21. The supply terminal 45 is present on the printed circuit board 40 and supplies the antenna 1 with electromagnetic energy to be radiated. Antennas with conductor track structures of this kind are described in DE 100 49 844.2.

In a practical realization of this antenna, a cuboid substrate 10 as shown in FIG. 1 was used, having a length A of 4 mm, a width C of 3 mm, and a height D of 2 mm.

Figure 3:
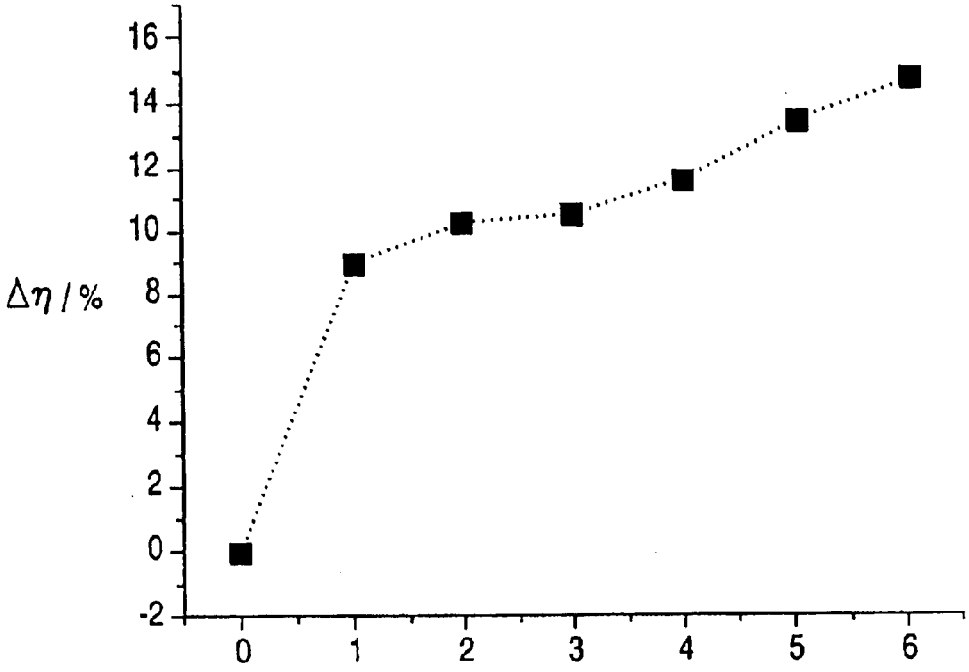
FIG. 3 is a graph showing the radiation efficiency of various embodiments of the antenna.

The radiation efficiencies of six embodiments 1 to 6 of this antenna with different dimensions of the channel 30 each time were measured and are shown in the graph of FIG. 3 in comparison with an embodiment 0 having a substrate without a cavity. The channel 30 extended over the entire length of the substrate 10 in each case, and the conductor track structures 20 were identical in all embodiments.

The individual embodiments have been given consecutive numbers 0 to 6 on the horizontal axis in FIG. 3, while the (relative) radiation efficiency in per cents is plotted on the vertical axis, i.e. in relation to the antenna having a substrate without cavity.

The graph shows very clearly that the radiation efficiency in all embodiments 1 to 6 is substantially higher than in the embodiment 0 with a substrate without cavity.

In detail, an absolute radiation efficiency of 42.2% was obtained for the embodiment 0 without channel. An absolute radiation efficiency of 51.2% was measured for the embodiment 1 with a channel cross-section of 1.5 by 1.5 $mm^2$. In embodiment 2, the channel cross-section was 0.5 by 0.5 $mm^2$, which resulted in an absolute radiation efficiency of 52.6%. The channel in embodiment 3 had a width B of 1.0 mm and a height H of 0.5 mm. A radiation efficiency of 52.8% was measured for this. In embodiment 4, the width B of the channel was enlarged to 2.0 mm and the height H of the channel to 1.0 mm. This resulted in a radiation efficiency of 53.9%. In embodiment 5, the channel had a width B of 1.0 mm and a height H of 1.5 mm, which gave a radiation efficiency of 55.9%. Embodiment 6, finally, had a channel cross-section of 1.0 by 1.0 $mm^2$. The greatest increase in the radiation efficiency was achieved with this embodiment, i.e. an efficiency of 57.2%, i.e. approximately 15% higher than in the embodiment 0 without cavity in the substrate.

In addition, the embodiment 6 of the antenna had a total weight which was 21% lower than that of the embodiment 0.

The preferred embodiment was described with reference to a cavity in the form of a channel. Alternatively, a plurality of cavities and cavities of alternative shapes are possible. The choice was made first and foremost with a view to a simple manufacture of the substrate, where in the simplest case a plurality of cylindrical bores was provided in the lower main surface 11 to a depth H such that the mechanical stability of the antenna is not jeopardized. The effect according to the invention, finally, may also be achieved through the use of foam-type (dielectric or permeable) substrates.

As an alternative to FIG. 2, the conductor track structure may also be formed by at least a first and a second conductor portion provided on the second main surface 12 of the substrate 10, which portions extend substantially in a meandering shape. This embodiment has the advantage in particular that the frequency distance between the first resonance frequency of the fundamental mode and the second resonance frequency can be adjusted at the first harmonic of the fundamental mode through a change in the distance between the two conductor portions. Antennas with conductor track structures of this kind are described in DE 100 49 845.0.

It should finally be noted that the shape and nature of the cavity of the substrate may be chosen substantially independently of the type of conductor track structure which is fed with the electromagnetic wave to be radiated.

What is claimed is:

1. A printed wire antenna with a dielectric or permeable substrate and a resonant conductor track structure, in particular for use in the high-frequency and microwave range without a metal reference potential surface in the immediate vicinity of the resonant conductor track structure, characterized in that the substrate comprises at least one cavity that is substantially isolated from the conductor track structure.

2. An antenna as claimed in claim 1, characterized in that the cavity is formed by at least one hollow space which is embraced by the substrate.

3. An antenna as claimed in claim 1, characterized in that the cavity is formed by at least one depression provided in one or several surfaces of the substrate.

4. An antenna as claimed in claim 3, characterized in that the depression is a channel which extends in a longitudinal direction of the substrate.

5. An antenna as claimed in claim 4, characterized in that the channel is substantially rectangular in cross-section and is provided in a first main surface of the substrate such that the latter is substantially U-shaped.

6. An antenna as claimed in claim 1, in particular for use in the high-frequency and microwave ranges, characterized in that the conductor track structure is a surface metallization which is formed by at least a first planar metallization structure on a second main surface as well as by a conductor track extending along at least part of the side faces of the substrate for the supply to the metallization structure of electromagnetic energy which is to be radiated.

7. A printed circuit board, in particular for surface mounting of electronic components, characterized by an antenna as claimed in claim 1.

8. A mobile telecommunication device, in particular for the Bluetooth, GSM, or UMTS range, characterized by an antenna as claimed in claim 1.

9. A printed wire antenna with a dielectric or permeable substrate and a resonant conductor track structure, in particular for use in the high-frequency and microwave ranges without a metal reference potential surface in the immediate vicinity of the resonant conductor track structure, characterized in that the substrate comprises at least one cavity and the conductor track structure is formed by at least a first and a second conductor portion provided on a surface of the substrate, which portions extend substantially in a meandering shape, while the frequency distance between the first resonance frequency of the fundamental mode and the second resonance frequency is adjustable at the first harmonic of the fundamental mode through a change in the distance between the two conductor portions.

10. An antenna as claimed in claim 9, characterized in that the cavity is formed by at least one hollow space which is embraced by the substrate.

11. An antenna as claimed in claim 9, characterized in that the cavity is formed by at least one depression provided in one or several surfaces of the substrate.

12. An antenna as claimed in claim 11, characterized in that the depression is a channel which extends in a longitudinal direction of the substrate.

13. An antenna as claimed in claim 12, characterized in that the channel is substantially rectangular in cross-section and is provided in a first main surface of the substrate such that the latter is substantially U-shaped.

14. A printed circuit board, in particular for surface mounting of electronic components, characterized by an antenna as claimed in claim 9.

15. A mobile telecommunication device, in particular for the Bluetooth, GSM, or UMTS range, characterized by an antenna as claimed in claim 9.

* * * * *